US011098868B2

(12) United States Patent
Sakaguchi et al.

(10) Patent No.: US 11,098,868 B2
(45) Date of Patent: Aug. 24, 2021

(54) LIGHTING DEVICE

(71) Applicant: Panasonic Intellectual Property Management Co., Ltd., Osaka (JP)

(72) Inventors: Tomohisa Sakaguchi, Kyoto (JP); Yosuke Araki, Osaka (JP); Kazumasa Takata, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/997,043

(22) Filed: Aug. 19, 2020

(65) Prior Publication Data

US 2021/0088195 A1 Mar. 25, 2021

(30) Foreign Application Priority Data

Sep. 25, 2019 (JP) ..... JP2019-173715

(51) Int. Cl.

| | |
|---|---|
| ***F21S 41/275*** | (2018.01) |
| ***F21V 5/00*** | (2018.01) |
| ***F21S 41/143*** | (2018.01) |
| ***F21S 41/30*** | (2018.01) |
| ***F21Y 115/10*** | (2016.01) |
| ***F21W 102/135*** | (2018.01) |

(52) U.S. Cl.

CPC ..... *F21S 41/275* (2018.01); *F21S 41/143* (2018.01); *F21S 41/30* (2018.01); *F21V 5/007* (2013.01); *F21V 5/008* (2013.01); *F21W 2102/135* (2018.01); *F21Y 2115/10* (2016.08)

(58) Field of Classification Search

CPC ..... F21S 41/143; F21S 41/275; F21S 41/30; F21V 5/007; F21V 5/008

See application file for complete search history.

(56) References Cited

U.S. PATENT DOCUMENTS

| | | | | |
|---|---|---|---|---|
| 2014/0092619 | A1* | 4/2014 | Bushre | F21S 41/40 362/520 |
| 2017/0122528 | A1 | 5/2017 | Kadoriku et al. | |
| 2018/0347776 | A1 | 12/2018 | Matsuda et al. | |

FOREIGN PATENT DOCUMENTS

| | | |
|---|---|---|
| JP | 4-055001 U | 5/1992 |
| JP | 2006-058714 | 3/2006 |
| JP | 6083011 B | 2/2017 |
| JP | 2018-206600 | 12/2018 |

* cited by examiner

*Primary Examiner* — Thomas M Sember
(74) *Attorney, Agent, or Firm* — Wenderoth, Lind & Ponack, L.L.P.

(57) ABSTRACT

A lighting device includes light emitting element; first lens that receives light emitted from light emitting element and emits first emission light; and second lens that receives the first emission light and emits second emission light. Second lens includes second convex incident surface receiving the first emission light, second convex emission surface that is provided on a right side of a drawing and emits the second emission light, and second top surface portion and second bottom surface portion each located between second incident surface and second emission surface. Second bottom surface portion includes first inclined surface and second inclined surface formed to be inclined with respect to an optical axis of light emitting element.

7 Claims, 4 Drawing Sheets

LIGHTING DEVICE

BACKGROUND

1. Technical Field

The present disclosure relates to a lighting device having a cutoff function.

2. Description of the Related Art

In the related art, in a case where a lighting device such as a vehicle headlight (headlight) is a passing headlight (low beam), the lighting device has a cutoff function by which light emitted upward is cut so that an oncoming vehicle or a pedestrian does not become dazzling. Even in a floodlight used for an outdoor ground, a luminous intensity distribution that cuts the light emitted upward is required so that the light does not leak to a peripheral portion of the ground.

Japanese Patent Unexamined Publication No. 2018-206600 discloses a vehicle headlight having a luminous intensity distribution so as to cut upper light in a case of the passing headlight. In Japanese Patent Unexamined Publication No. 2018-206600, light incident upward a first lens is reflected downward by a second reflection surface formed on the first lens, so that the light on the upper side is cut.

The light reflected by the second reflection surface is superposed on the light not reflected by the second reflection surface and is incident on a lower portion of the second lens. Therefore, it is possible to prevent a decrease in optical efficiency.

The second lens has a convex light incident portion. Therefore, the light incident on a side wall (side surface portion) of the second lens can be reduced, and stray light generated in a case where the light incident on the side wall of the second lens is reflected can be suppressed.

SUMMARY

A lighting device according to one aspect of the present disclosure includes a light emitting element; a first lens that receives light emitted from the light emitting element and emits first emission light; and a second lens that receives the first emission light and emits second emission light. The second lens includes a second convex incident surface that receives the first emission light; a second convex emission surface that is provided at a position facing the second incident surface and emits the second emission light; and a second top surface portion and a second bottom surface portion each located between the second incident surface and the second emission surface. The second bottom surface portion is inclined with respect to an optical axis of the light emitting element.

DETAILED DESCRIPTIONS

In Japanese Patent Unexamined Publication No. 2018-206600, in order to reduce the light incident on a side wall of a second lens, it is necessary to make an incident surface of the second lens larger than an emission surface of a first lens. For example, in order to block the light incident on a side wall of the second lens, it is necessary to make a length of the incident surface of the second lens in a vertical direction be substantially three times a length of the emission surface of the first lens or greater in the vertical direction. Therefore, a size of the lighting device is large.

An object of the present disclosure is to provide a lighting device of which a size is suppressed while preventing stray light and a decrease in optical efficiency.

Hereinafter, exemplary embodiments of the present disclosure will be described in detail with reference to the drawings. The description of the preferred exemplary embodiments below is merely an example in nature and is not intended to limit the present disclosure, an application thereof, or a use thereof.

Figure 1:
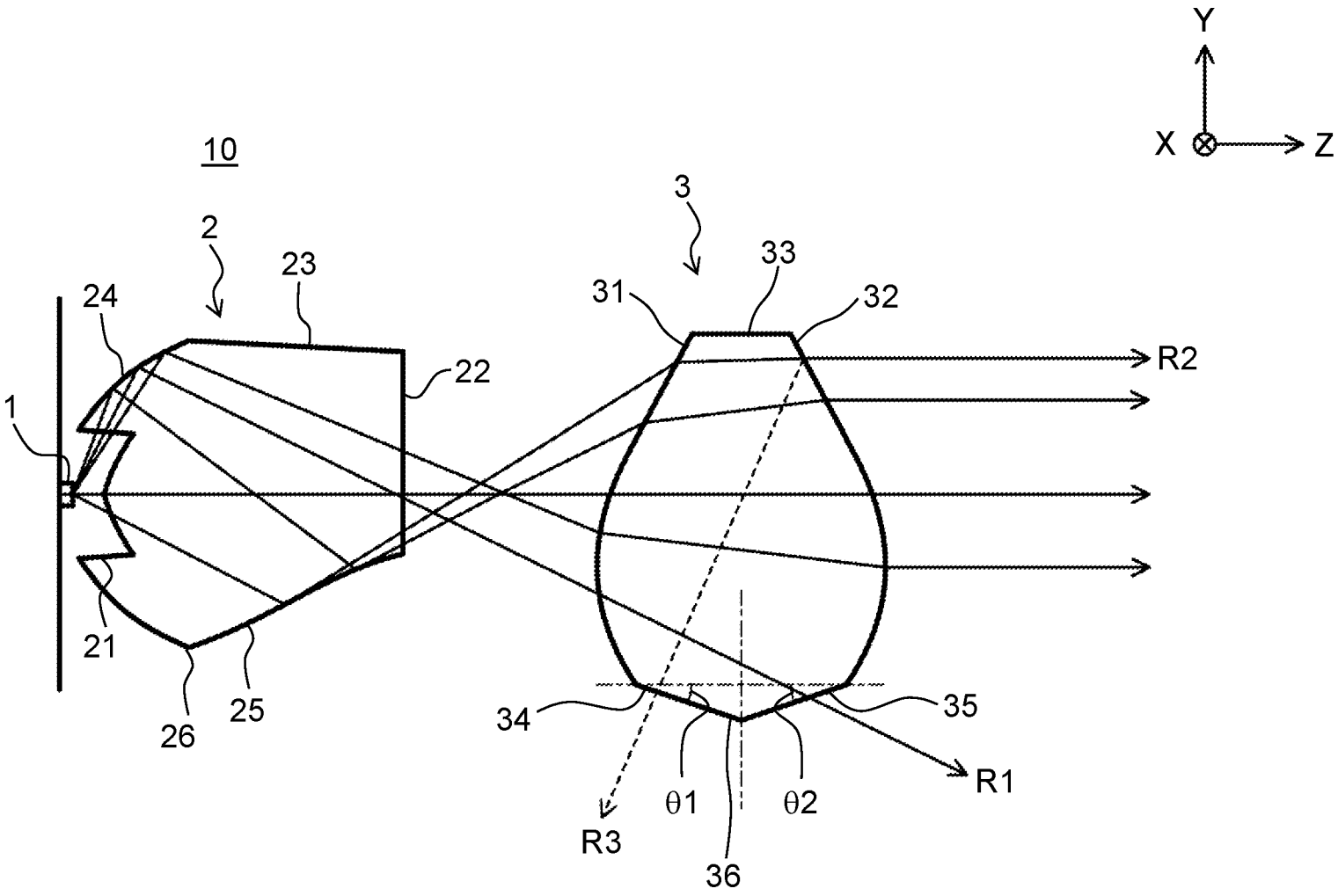
FIG. 1 is a side view of a lighting device according to an exemplary embodiment.
Figure 2:
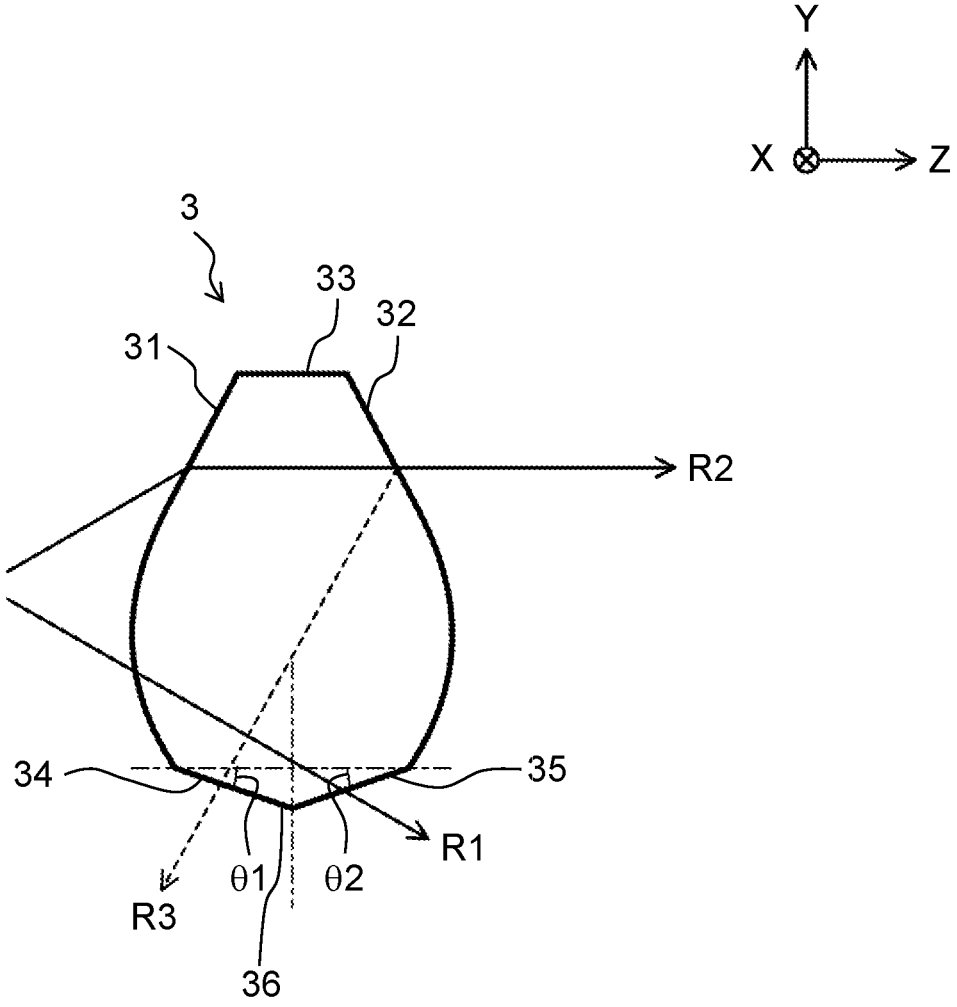
FIG. 2 is a side view of a second lens according to the present exemplary embodiment.

FIG. 1 illustrates a side view of a lighting device according to the present exemplary embodiment, and FIG. 2 illustrates a side view of a second lens according to the present exemplary embodiment. In the following description, an optical axis of a light emitting element is a Z-axis, and a traveling direction of light emitted from the light emitting element is a positive direction (hereinafter, also referred to as an optical axis direction of light emitting element 1) of the Z-axis. AY-axis is orthogonal to the optical axis and extends in the vertical direction, and an X-axis is perpendicular to the Y-axis and the Z-axis.

Lighting device 10 according to the present exemplary embodiment includes light emitting element 1, first lens 2, and second lens 3.

Light emitting element 1 is configured of an LED or the like and has an optical axis on the Z-axis.

First lens 2 receives light emitted from light emitting element 1 and emits the first emission light to second lens 3. Specifically, first lens 2 includes first incident port 21, first emission surface 22, and first top surface portion 23 and first bottom surface portion 26 provided between first incident port 21 and first emission surface 22. First top surface portion 23 and first bottom surface portion 26 are collectively referred to as a first side surface portion.

First incident port 21 is formed on a left side of first lens 2 in the drawing, and is formed in a concave shape so as to surround light emitting element 1. First incident port 21 receives the light emitted from light emitting element 1.

First top surface portion 23 includes first reflection surface 24. A first bottom surface portion includes second reflection surface 25.

First reflection surface 24 is formed so as to spread from an upper end portion of an opening of first incident port 21 obliquely upward to the right in the drawing and on the X-axis. First reflection surface 24 reflects the light incident on first lens 2 from first incident port 21 toward first emission surface 22 or toward second reflection surface 25.

Second reflection surface 25 is formed so as to spread from a lower end portion of first emission surface 22 obliquely downward to the left in the drawing and on the X-axis. Second reflection surface 25 reflects the light incident on first lens 2 from first incident port 21 toward first emission surface 22. Second reflection surface 25 also reflects the light reflected by first reflection surface 24 toward first emission surface 22.

First emission surface 22 is formed on the right side of first lens 2 in the drawing. First emission surface 22 emits, to second lens 3, the light emitted from light emitting element 1, the light reflected by first reflection surface 24, and the light reflected by second reflection surface 25 as the first emission light.

In first lens 2, the light emitted from light emitting element 1 toward the lower side of the drawing is reflected by second reflection surface 25 and emitted from first emission surface 22 toward the upper side of the drawing. Therefore, second reflection surface 25 cuts the light emitted from first emission surface 22 toward the lower side of the drawing.

The light emitted from light emitting element 1 toward the upper side of the drawing is reflected by first reflection surface 24 toward the lower side of the drawing, and is reflected by second reflection surface 25 toward the upper side of the drawing. Thus, the light is emitted from first emission surface 22 toward the upper side of the drawing. Therefore, the optical efficiency of lighting device 10 can be increased by first reflection surface 24 and second reflection surface 25.

Second lens 3 receives the first emission light emitted from first lens 2 and emits the second emission light. Second lens 3 is an anamorphic lens having different curvatures on the Y-axis and the X-axis. A thickness of second lens 3 on the Y-axis is thicker than a thickness thereof on the Z-axis. The thickness of second lens 3 on the Y-axis is 1 time or greater and 2 times or less the thickness of the first lens on the Y-axis.

Specifically, second lens 3 includes second incident surface 31, second emission surface 32, and second top surface portion 33 and second bottom surface portion 36 provided between second incident surface 31 and second emission surface 32. Second top surface portion 33 and second bottom surface portion 36 are collectively referred to as a second side surface portion.

Second incident surface 31 is formed on the left side of second lens 3 in the drawing, and is formed so as to be convex in the negative direction of the Z-axis. Second incident surface 31 receives the first emission light emitted from first emission surface 22 of first lens 2.

Second emission surface 32 is formed on the right side of second lens 3 in the drawing, and is formed so as to be convex in the positive direction of the Z-axis. Second emission surface 32 emits the light incident on second lens 3 as the second emission light.

Figure 4:
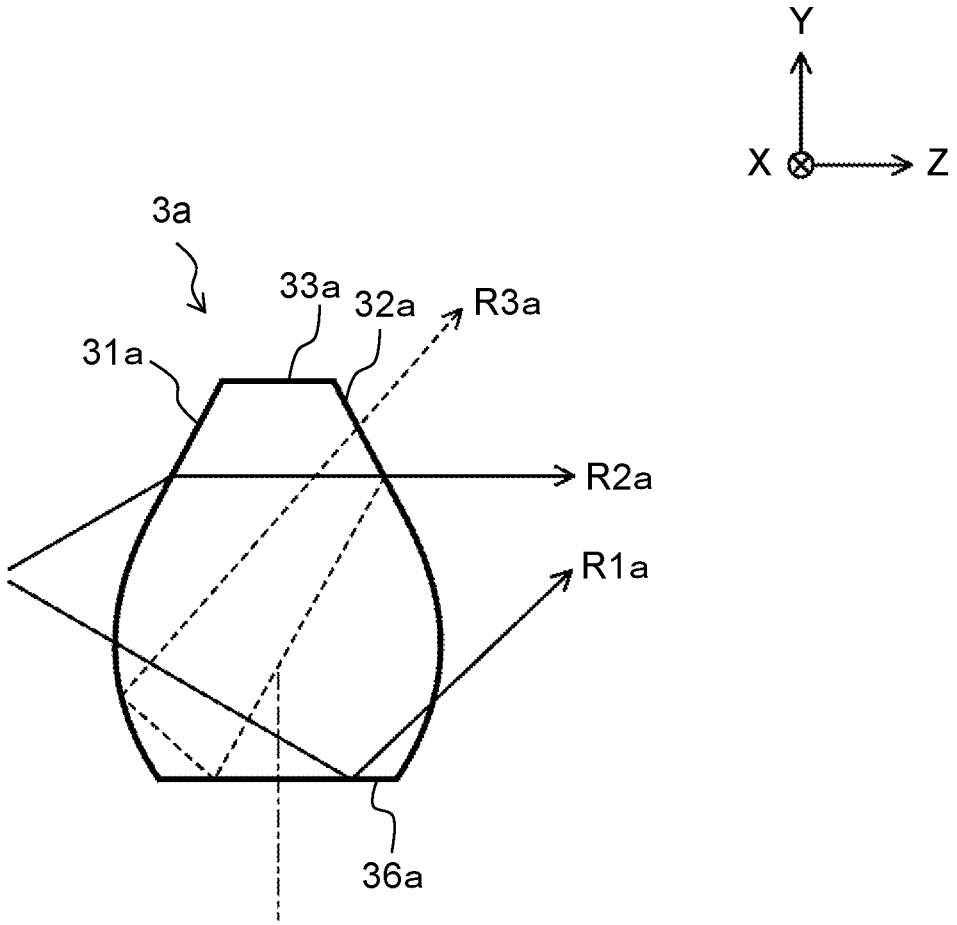
FIG. 4 is a side view of a second lens of a lighting device of the related art.

FIG. 4 illustrates a side view of a second lens of the related art. In second lens 3*a* of the related art, the lower portion of second side surface portion 33*a* in the drawing is formed by flat surface 36*a* parallel to the Z-axis. In FIG. 4, emission light R1*a* is light reflected by first reflection surface 24 of first lens 2 and incident on second incident surface 31*a*. Emission light R2*a* is light reflected by second reflection surface 25 and incident on second incident surface 31*a*.

In second lens 3*a* of the related art, emission light R1*a* incident on the lower portion of second lens 3*a* in the drawing has a large incident angle with respect to flat surface 36*a*, and thus is reflected by flat surface 36*a* upward in the drawing. Emission light R2*a* incident on the upper portion of second lens 3*a* in the drawing is partly reflected by second emission surface 32*a* of second lens 3*a*. Emission light R3*a* reflected by second emission surface 32*a* is reflected by flat surface 36*a* and second incident surface 31*a*, and is emitted upward in the drawing. Therefore, in second lens 3*a* of the related art, each of emission lights R1*a* and R3*a* is stray light. In order to prevent this stray light, it is necessary to make the thickness of second lens 3*a* on the Z-axis sufficiently large.

Therefore, in second lens 3 according to the present exemplary embodiment, second bottom surface portion 36 includes first inclined surface 34 and second inclined surface 35. Lower end portions of first inclined surface 34 and second inclined surface 35 are connected to each other. Second bottom surface portion 36 has a convex shape protruding in the negative direction (downward) of the Y-axis.

First inclined surface 34 is a flat surface formed so as to extend from the lower end portion of second incident surface 31 obliquely downward to the right in the drawing (positive direction of the Z-axis and negative direction of the Y-axis). First inclined surface 34 is formed such that angle θ1 with the Z-axis (optical axis direction of light emitting element 1) is 20°.

Second inclined surface 35 is a flat surface formed so as to extend from the lower end portion of second emission surface 32 obliquely downward to the left in the drawing (negative direction of Z-axis and negative direction of Y-axis). Second inclined surface 35 is formed such that angle θ2 with the Z-axis (optical axis direction of light emitting element 1) is 20°.

As illustrated in FIG. 2, since angle θ2 formed by second inclined surface 35 and the Z-axis is 20°, the incident angle of emission light R1 on second inclined surface 35 is small. Therefore, emission light R1 is not reflected by second inclined surface 35 but is transmitted. Thereby, since emission light R1 is not emitted from second emission surface 32, emission light R1 can be easily blocked.

Since angle θ1 formed by first inclined surface 34 and the Z-axis is 20°, the incident angle of emission light R3 on first inclined surface 34 is small, and emission light R3 is not reflected by first inclined surface 34 but is transmitted. Thereby, since emission light R3 is not emitted from second emission surface 32, emission light R3 can be easily blocked.

With the configuration described above, second lens 3 includes second convex incident surface 31 that is provided on the left side of the drawing and receives the first emission light, second convex emission surface 32 that is provided on the right side of the drawing and emits the second emission light, and second top surface portion 33 and second bottom surface portion 36 each located between second incident surface 31 and second emission surface 32. Second bottom surface portion 36 includes first inclined surface 34 and second inclined surface 35 that are formed so as to be inclined with respect to the Z-axis (optical axis of light emitting element 1). That is, since second bottom surface portion 36 includes first inclined surface 34 and second inclined surface 35 that are inclined with respect to the Z-axis, emission lights R1 and R3 incident on first inclined surface 34 and second inclined surface 35 are less likely to be reflected, and easily transmit first inclined surface 34 and second inclined surface 35. Therefore, since emission lights R1 and R3 are less likely to be emitted from second emission surface 32, emission lights R1 and R3 can be easily blocked while suppressing the size of lighting device 10. Therefore, the size can be suppressed while preventing the stray light and a decrease in optical efficiency.

First inclined surface 34 and second inclined surface 35 are flat surfaces. Therefore, it is possible to suppress that a surface shape of second lens 3 is complicated, so that second lens 3 can be easily manufactured.

Each of first inclined surface 34 and second inclined surface 35 has an angle of 20° between a direction in which the flat surface extends and the Z-axis. Therefore, since emission light R1 reflected by first reflection surface 24 and incident on second bottom surface portion 36 transmits second inclined surface 35, and emission light R3 reflected by second emission surface 32 and incident on second bottom surface portion 36 transmits first inclined surface 34, emission lights R1 and R3 can be easily blocked. Since the angles formed by first inclined surface 34, second inclined surface 35, and the Z-axis are respectively small, the size of lighting device 10 can be suppressed.

Figure 3:
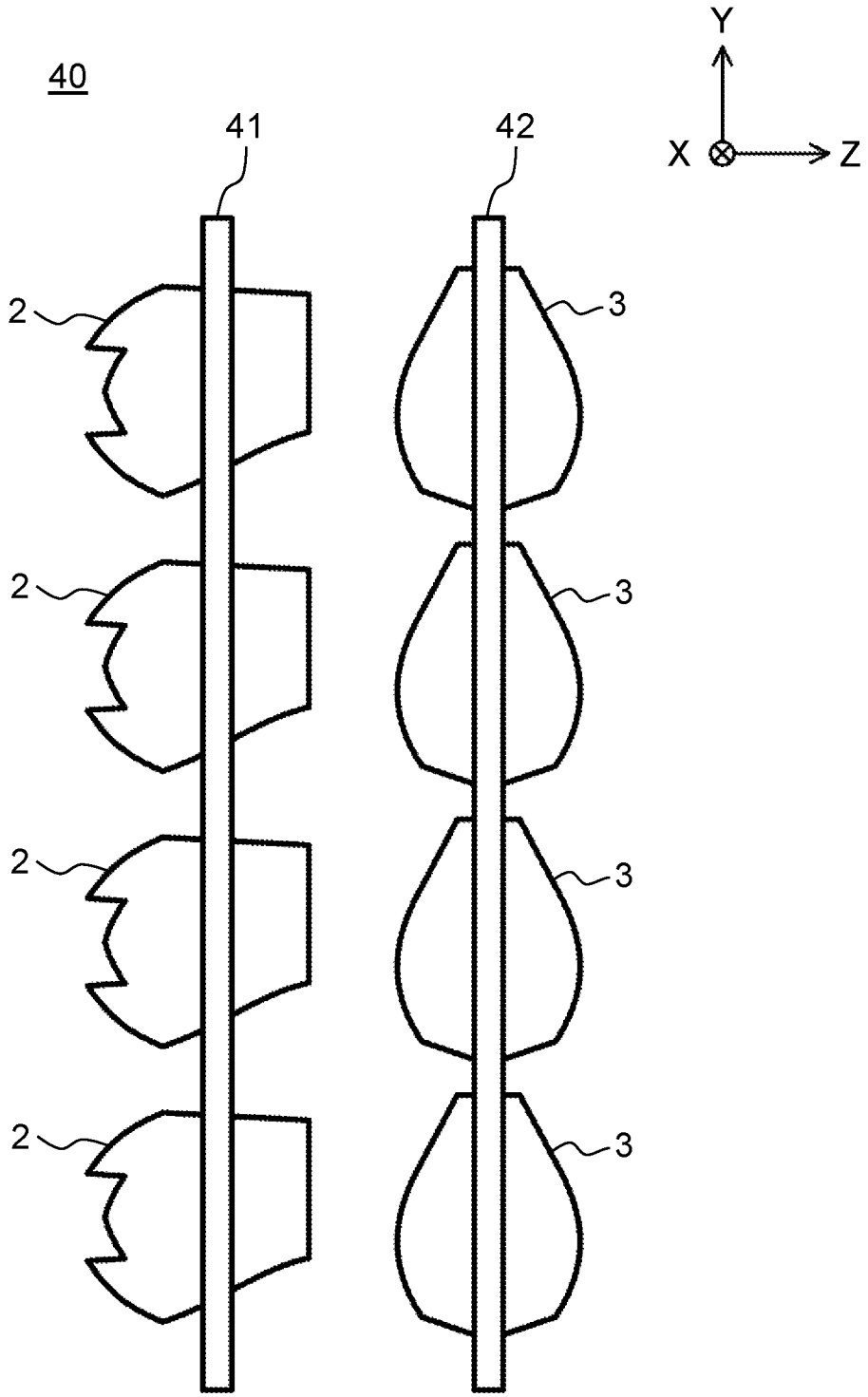
FIG. 3 is a view illustrating an application example of the lighting device according to the present exemplary embodiment.

FIG. 3 is a view illustrating a lighting device in which a plurality of first lenses and second lenses according to the present exemplary embodiment are disposed in an array shape. As illustrated in FIG. 3, the plurality of first lenses 2 and the plurality of second lenses 3 are disposed at equal intervals on the Y-axis. The plurality of first lenses 2 and the plurality of second lenses 3 are respectively fixed by fixing portion 41 and fixing portion 42 extending on the Y-axis. According to the present exemplary embodiment, the thickness of second lens 3 on the Y-axis can be made thinner than that of second lens 3*a* of the related art illustrated in FIG. 4. Thereby, as illustrated in FIG. 3, when first lens 2 and second lens 3 are disposed in the array shape, the size of lighting device 40 can be suppressed.

Other Exemplary Embodiments

The exemplary embodiments are described above as examples of the technique disclosed in the present application. However, the technique in the present disclosure is not limited to these, and is also applicable to exemplary embodiments in which changes, replacements, additions, omissions, and the like are appropriately made.

In the exemplary embodiments described above, angles θ1 and θ2 formed by first inclined surface 34 and second inclined surface 35 of second lens 3 with the Z direction are not limited to 20°. For example, each of angles θ1 and θ2 may be 0° or greater and 30° or less. Therefore, the size of lighting device 10 can be suppressed.

In the exemplary embodiments described above, second bottom surface portion 36 of second lens 3 may include a flat surface other than first inclined surface 34 and second inclined surface 35. Second bottom surface portion 36 of second lens 3 may include a curved surface without including either first inclined surface 34 or second inclined surface 35. However, second bottom surface portion 36 of second lens 3 includes a surface inclined with respect to the Z-axis in the negative direction of the Y-axis. That is, second bottom surface portion 36 has a convex shape protruding in the negative direction of the Y-axis. Second bottom surface portion 36 may include a plurality of flat surfaces, a plurality of curved surfaces, or one flat surface or greater and one curved surface or greater.

According to the present disclosure, the size of lighting device 10 can be suppressed while preventing the stray light and a decrease in optical efficiency.

The lighting device of the present disclosure can be applied to a lighting device having a cutoff function, such as a vehicle headlight and floodlight installed on the ground.

What is claimed is:

1. A lighting device comprising:

a light emitting element;

a first lens that receives light emitted from the light emitting element and emits first emission light; and a second lens that receives the first emission light and emits second emission light, wherein the second lens includes a second incident surface that is convex and receives the first emission light, a second emission surface that is convex and provided at a position facing the second incident surface and emits the second emission light, and a second top surface portion and a second bottom surface portion each located between the second incident surface and the second emission surface, wherein the second bottom surface portion includes a surface inclined with respect to an optical axis of the light emitting element, wherein the inclined surface of the second bottom surface portion includes a plurality of flat surfaces, and wherein the plurality of flat surfaces include a first inclined surface extending from an end portion of the second incident surface toward a second emission surface side, and a second inclined surface extending from an end portion of the second emission surface toward a second incident surface side and being connected to the first inclined surface.

2. The lighting device of claim 1, wherein each of the first inclined surface and the second inclined surface has an angle of 30 degrees or less with respect to the optical axis of the light emitting element.

3. The lighting device of claim 1, wherein the first lens includes a first incident port having a concave shape covering the light emitting element, the first incident port receiving light generated by the light emitting element, and a first emission surface facing the first incident port and emitting the first emission light, and wherein the second emission surface has a length in a vertical direction that is two times a length of the first emission surface or less in the vertical direction.

4. The lighting device of claim 1, wherein a combination of the first lens and the second lens is disposed in an array shape.

5. A lighting device comprising:

a light emitting element;

a first lens that receives light emitted from the light emitting element and emits first emission light; and a second lens that receives the first emission light and emits second emission light, wherein the first lens includes a first incident port having a concave shape covering the light emitting element, the first incident port receiving light generated by the light emitting element, a first emission surface facing the first incident port and emitting the first emission light, and a first top surface portion and a first bottom surface portion each located between the first incident port and the first emission surface, wherein the first top surface portion includes a first reflection surface that reflects, to a first emission surface side, the light incident on the first incident port from the light emitting element, and wherein the first bottom surface portion includes a second reflection surface that reflects, to the first emission surface side, the light incident on the first incident port from the light emitting element and the light reflected by the first reflection surface, and wherein the second lens includes a second incident surface that is convex and receives the first emission light, a second emission surface that is convex and provided at a position facing the second incident surface and emits the second emission light, and a second top surface portion and a second bottom surface portion each located between the second incident surface and the second emission surface, wherein the second bottom surface portion includes a surface inclined with respect to an optical axis of the light emitting element.

6. The lighting device of claim 5, wherein the second emission surface has a length in a vertical direction that is two times a length of the first emission surface or less in the vertical direction.

7. The lighting device of claim 5, wherein a combination of the first lens and the second lens is disposed in an array shape.

* * * * *